US006837216B1

(12) United States Patent
Tanabe

(10) Patent No.: US 6,837,216 B1
(45) Date of Patent: Jan. 4, 2005

(54) ELECTRONIC THROTTLE CONTROL SYSTEM

(75) Inventor: Tsuneo Tanabe, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/786,327

(22) Filed: Feb. 26, 2004

(30) Foreign Application Priority Data

Sep. 1, 2003 (JP) ..... 2003-309028

(51) Int. Cl.[7] ..... F02D 9/08

(52) U.S. Cl. ..... 123/396; 123/399; 123/397; 73/118.2; 701/114; 701/115

(58) Field of Search ..... 123/396, 397, 123/399; 73/118.1, 118.2; 701/114, 115

(56) References Cited

U.S. PATENT DOCUMENTS 5,746,174 A * 5/1998 Abe et al. ..... 73/118.1
6,711,492 B1 * 3/2004 Pursifull et al. ..... 701/114
6,775,609 B2 * 8/2004 Ozeki et al. ..... 123/396
2003/0182050 A1 * 9/2003 Maegawa et al. ..... 701/114

FOREIGN PATENT DOCUMENTS

JP 11-082133 A 3/1999
JP 2001-065403 A 3/2001

* cited by examiner

*Primary Examiner*—Erick Solis
(74) *Attorney, Agent, or Firm*—Sughrue Mion, PLLC

(57) ABSTRACT

An electronic throttle control system includes an electronic control unit that performs failsafe control for cases where failure of throttle valve is detected, and stores failure information about the throttle valve in a memory 1*a* so that the failure information can be referenced by an external tool during failure diagnosis, and that initializes the memory 1*a* when failure diagnosis is complete. The electronic throttle control system further includes a crank angle sensor for detecting engine speed. The electronic control unit initializes the memory that stores failure information relating to electronic control of the throttle valve for cases where an initialization request signal for initializing the memory that stores the throttle valve failure information is inputted from the external tool, and the engine speed that is computed based on the crank angle detected by the crank angle sensor is zero.

3 Claims, 3 Drawing Sheets

ELECTRONIC THROTTLE CONTROL SYSTEM

BACKGROUND OF THE INVENTION

1. Field of the Invention

The present invention relates to an electronic throttle control system that performs initialization of memory that stores failure information relating to electronic control of a throttle valve at a predetermined timing.

2. Description of the Related Art

Conventionally, when a mode switch on an electronic control unit (ECU) is set to OFF, normal engine control is performed for controlling a throttle opening according to an operational state. When an ON mode switch setting is detected, the throttle opening is controlled to drive a throttle actuator so that a specific operation pattern suited to diagnosing failure is performed, thus performing self-diagnosis for detecting system abnormalities. Failure diagnosis can thus be performed swiftly and accurately, without the diagnosis being stopped during the vehicle check because the throttle opening changes due to an accelerator operation mistake by an operator, causing deviation from the specific operation pattern. The vehicle checking efficiency can thus increase (for example, refer to JP 11-82133 A (page 1, FIG. 1)).

The conventional system described above eliminates operational mistakes made by the operator by automatically producing a specific operation pattern (throttle valve control pattern) for failure diagnosis. Operational mistakes can be eliminated because there is no accelerator operation by the operator when this type of system is used. However, failure of the throttle valve and the like developing during the specific operation pattern of the vehicle has not been considered.

Further, throttle valve failure and throttle position sensor failure are detected with conventional electronic throttle valve control. When these types of failure are detected, the throttle valve control is stopped in order to ensure vehicle reliability, and failsafe control, such as fixing the throttle valve opening to a predetermined position, is performed.

This failsafe control continues until an electric power source for an ECU is turned off. Information in order for the failsafe control to continue, and information on a failure location that has caused the failsafe control to be performed, are stored in a memory as failure information relating to the throttle valve electronic control.

However, there are cases where it becomes necessary to initialize the memory that stores the failure information after repairing the detected failure location, during verification by performing failure detection again while the vehicle ignition is on, and the like. The ECU therefore has a function whereby it is possible to initialize the memory that stores the failure information by using a tool that is connected from an external portion.

There are also cases where initialization of the memory that stores the failure information is performed when a failure mode develops that leads to a state in which the throttle valve opens more than necessary, after which failure detection is performed, and the vehicle is operated in a state where the vehicle reliability is maintained by the failsafe control.

However, there is a problem when the vehicle is operated in a state where the vehicle reliability is maintained by this type of failsafe control. Once the memory that stores the failure information relating to the throttle valve electronic control is initialized, a state again results where the throttle valve opens more than necessary.

SUMMARY OF THE INVENTION

The present invention has been made in order to resolve the problems described above. An object of the present invention is to obtain an electronic throttle control system in which vehicle reliability can be assured, even if a memory that stores failure information relating to electronic control of a throttle valve is initialized.

According to the present invention, there is provided an electronic throttle control system including: an electronic control unit that performs failsafe control for cases where throttle valve failure is detected, and stores failure information about the throttle valve in a memory so that the failure information can be referenced by an external tool during failure diagnosis, and that initializes the memory when repair of the failure location is complete, or in order to reconfirm the failure location; and an operation state detection sensor for detecting an operation state of a vehicle, in which the electronic control unit initializes the memory for cases where an initialization request signal for initializing the memory that stores the throttle valve failure information is input from the external tool, and the operation state of the vehicle detected by the operation state detection sensor is a stopped state.

An electronic throttle control system according to the present invention has an effect that can assure vehicle reliability even if a memory that stores failure information relating to electronic control of a throttle valve is initialized.

DETAILED DESCRIPTION OF THE PREFERRED EMBODIMENTS

Embodiment 1

Figure 1:
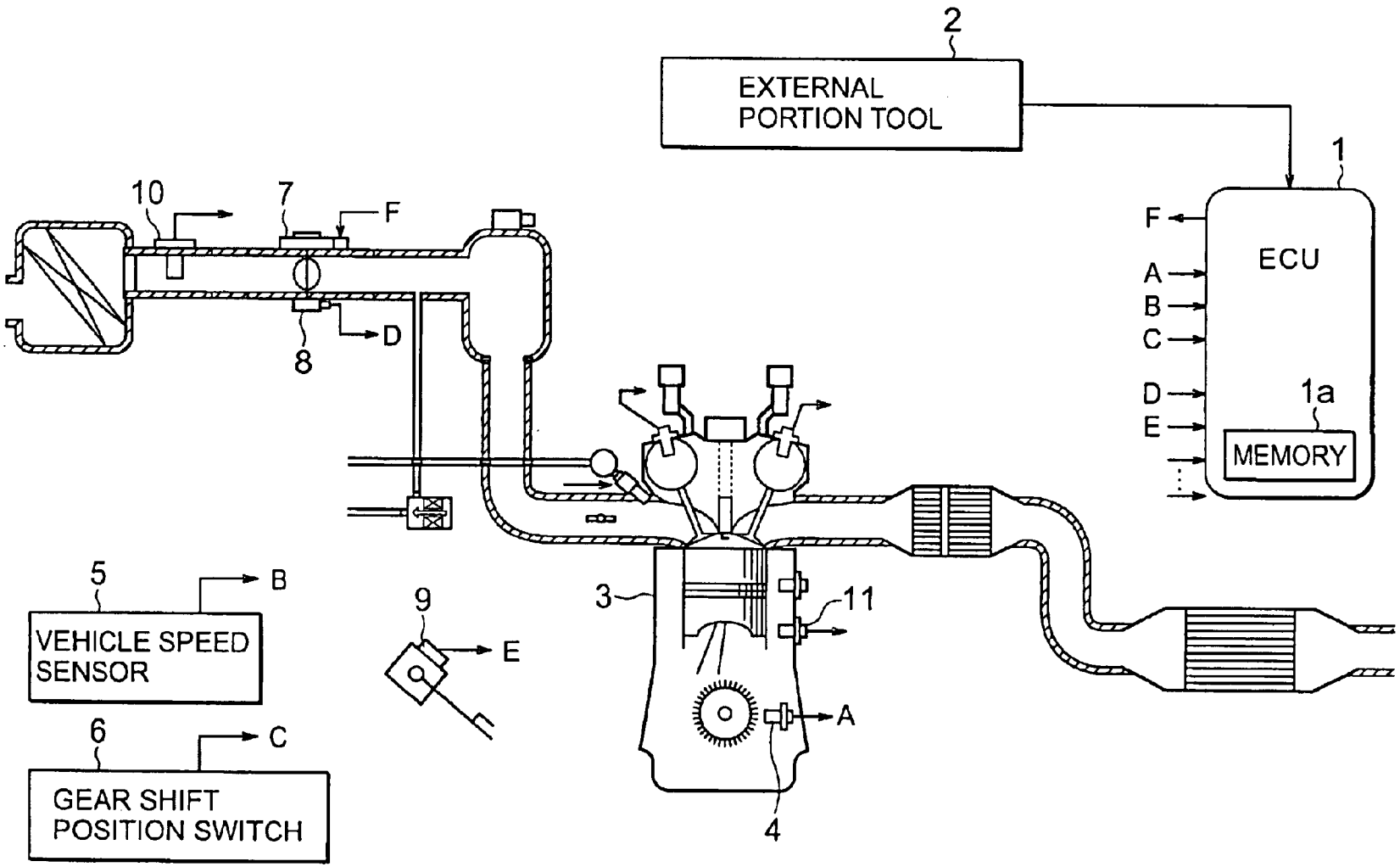
FIG. 1 is a diagram showing a configuration of an electronic throttle control system according to Embodiment 1 of the present invention.

An electronic throttle control system according to Embodiment 1 of the present invention is explained while referring to the drawings. FIG. 1 is a diagram showing a configuration of the electronic throttle control system according to Embodiment 1 of the present invention.

In FIG. 1, an electronic control unit (ECU) 1 contains a microcomputer, a memory 1*a,* and the like, and electronically controls an internal combustion engine 3. A crank angle sensor (operation state detection sensor) 4 for detecting engine speed, a vehicle speed sensor (operation state detection sensor) 5 that detects vehicle speed, a shift position switch (SW) (operation state detection sensor) 6 that detects a shift position, and a throttle position sensor 8 that detects a position of a throttle valve 7 are connected to the ECU 1. In addition, various other types of sensors, such as an accelerator position sensor 9 that detects an amount that an accelerator pedal is pressed, an airflow sensor 10 for measuring an amount of aspirated air, and a coolant temperature sensor 11 are connected to the ECU 1. During failure diagnosis, an external tool 2 such as a portable failure diagnosis device is connected to the ECU 1.

Operation of the electronic throttle control system according to Embodiment 1 is explained next while referring to the drawings.

Further, the ECU 1 in electronic throttle valve control detects failure of throttle valve 7 and failure of throttle position sensor 8. When these types of failure are detected, control of the throttle valve 7 is stopped in order to ensure vehicle reliability, and failsafe control, such as fixing opening of the throttle valve 7 to a predetermined position, is performed.

This failsafe control continues until an electric power source for the ECU 1 is turned off. Information in order for the failsafe control to continue, and information on a failure location that has caused the failsafe control to be performed, are stored by the ECU 1 in a memory 1*a* as failure information relating to the throttle valve electronic control.

However, there are cases where it becomes necessary to initialize the memory that stores the failure information after repairing the detected failure location, during verification by performing failure detection again while the vehicle ignition is on, and the like. The ECU 1 therefore has a function whereby it is possible to initialize the memory that stores the failure information by using a tool 2 that is connected from an external portion.

Figure 2:
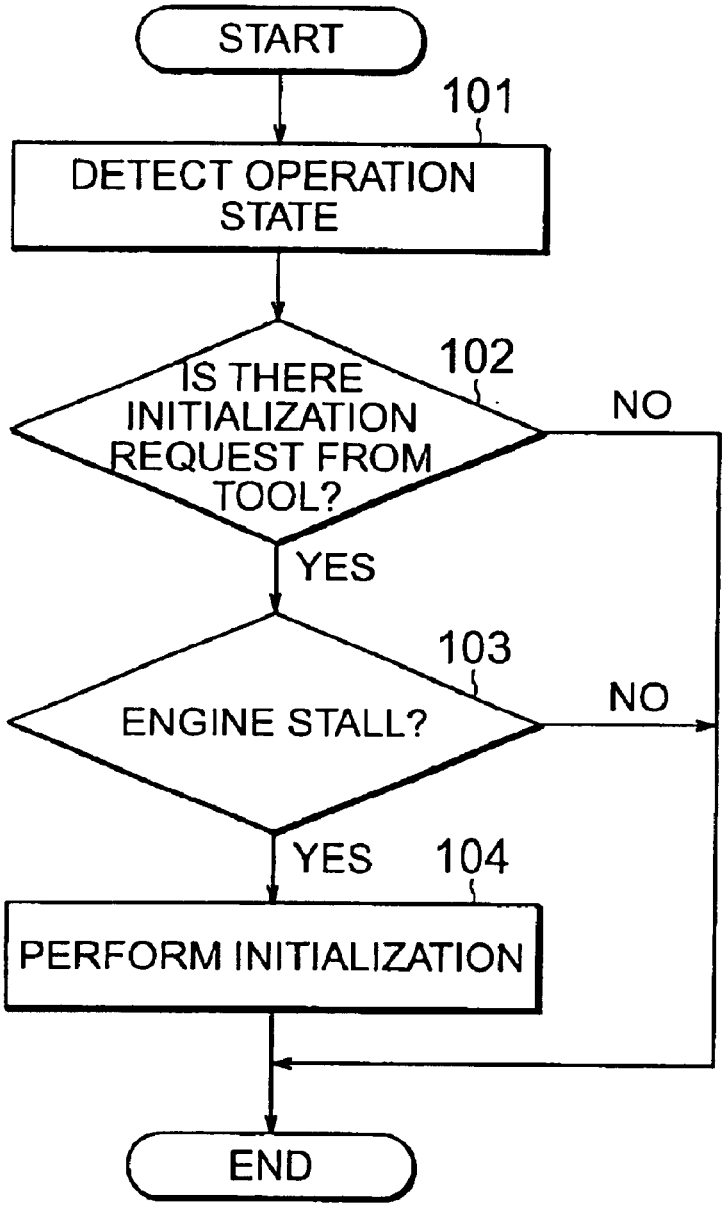
FIG. 2 is a flowchart showing initialization operations for a memory that stores failure information for the electronic throttle control system according to Embodiment 1 of the present invention.

FIG. 2 is a flowchart showing initialization operations for the memory that stores failure information for the electronic throttle control system according to Embodiment 1 of the present invention. Routines in FIG. 2 express an initialization function for the memory that stores the failure information of the electronic control unit, and processing is performed at predetermined intervals of time.

First, in step 101, the electronic control unit 1 detects the operation state from each type of sensor. That is, the crank angle is read in from the crank angle sensor 4 in order to compute the engine speed.

Next, in step 102, a judgement is made as to whether or not there is a request for initialization from the external tool 2. Processing by this routine ends for cases where there is no request for initialization. When there is a request for initialization, processing advances to a next step 103. That is, the external tool 2 is connected to the electronic control unit 1 during failure diagnosis, and if there is an initialization request signal inputted from the external tool 2 after a failure location has been repaired, in order to reconfirm the failure location, or the like, processing proceeds to the next step 103.

For cases where failure to the throttle valve 7 or the throttle position sensor 8 is detected, the detected failure location is repaired. When the failure is detected, it is stored in the memory 1*a* as failure information relating to electronic control of the throttle valve, and therefore it is necessary to reset the failure information after the failure location is repaired. The memory that stores the failure information is then initialized by using the external tool 2.

Next, in step 103, the electronic control unit 1 judges whether or not the engine is in a stalled state. Processing by this routine ends for cases where the engine is not in a stalled state. When the engine is in a stalled state, processing proceeds next to a step 104. That is, when the engine speed computed based on the read in crank angle is zero (0), the engine is judged to be in a stalled state, and processing proceeds to the next step 104.

Then, in step 104, the electronic control unit 1 performs initialization of the memory that stores failure information relating to electronic control of the throttle valve 7. That is, the memory 1*a* that stores the failure information relating to electronic control of the throttle valve 7 is initialized. For example, an applicable area of the memory 1*a* is changed to initial values present when a battery is connected.

That is, the electronic throttle control system includes an n electronic control unit 1 that performs failsafe control for cases where failure or the like of throttle valve 7 is detected, and stores failure information about the throttle valve 7 in a memory 1*a* so that the failure information can be referenced by an external tool 2 during failure diagnosis, and that initializes the memory 1*a* when repair of the failure location is complete, or in order to reconfirm the failure location. The electronic control unit 1 initializes the memory 1*a* for cases where an initialization request signal for initializing the memory 1*a* that stores failure information or the like of the throttle valve 7 is inputted from the external tool 2, and the engine speed that is computed based on the crank angle detected by the crank angle sensor 4 is zero. According to Embodiment 1, by initializing the memory 1*a* that stores the failure information, the engine is in a stalled state even for cases where the throttle valve 7 is in a failed state, failsafe control has been released, and the throttle is completely open. Vehicle reliability can therefore be assured without influencing vehicle behavior.

Embodiment 2

An electronic throttle control system according to Embodiment 2 of the present invention is explained while referring to the drawings. The configuration of the electronic throttle control system according to Embodiment 2 of the present invention is similar to that of FIG. 1, except for the functions of the electronic control unit.

Figure 3:
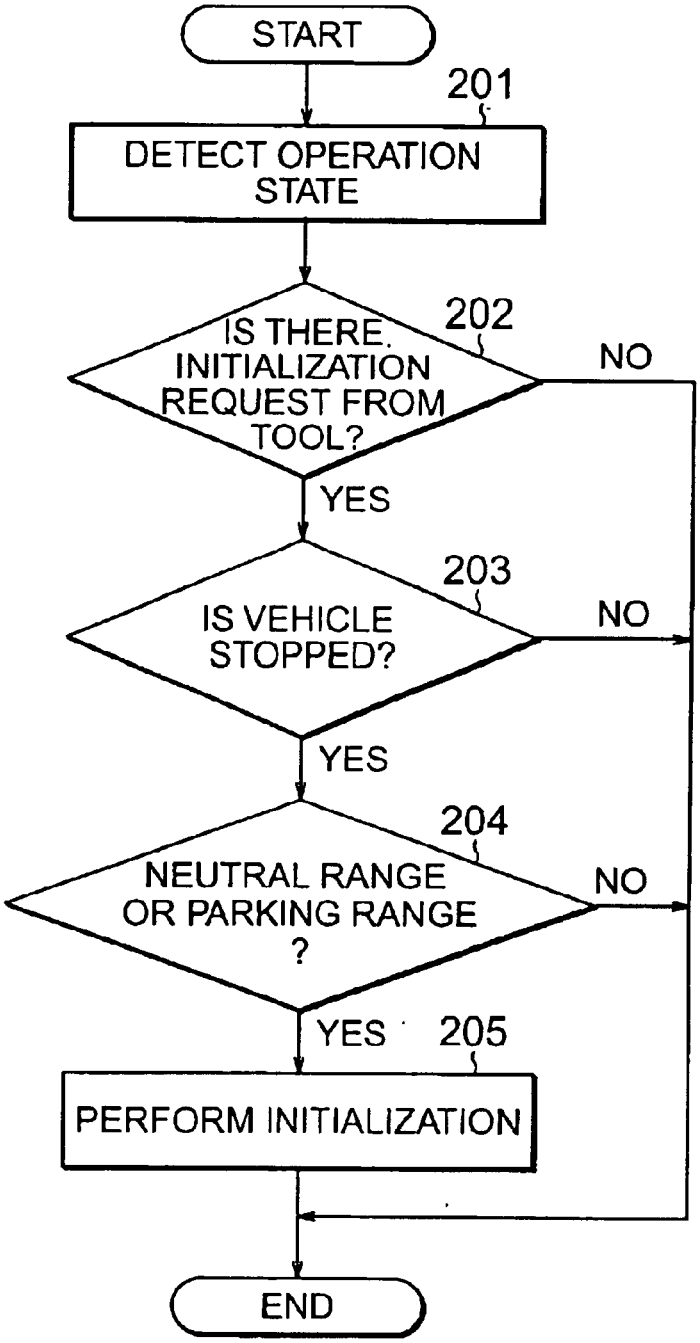
FIG. 3 is a flowchart showing initialization operations for a memory that stores failure information for an electronic throttle control system according to Embodiment 2 of the present invention.

Operation of the electronic throttle control system according to Embodiment 2 is explained next while referring to the drawings. FIG. 3 is a flowchart showing initialization operations for the memory that stores failure information for the electronic throttle control system according to Embodiment 2 of the present invention. Routines in FIG. 3 express an initialization function for the memory that stores the failure information of the electronic control unit, and processing is performed at predetermined intervals of time.

First, in step 201, the electronic control unit 1 detects the operation state from each type of sensor. That is, the vehicle speed is read in from the vehicle speed sensor 5. Further, the shift position is read in from the shift position switch (SW) 6.

Next, in step 202, a judgement is made as to whether or not there is a request for initialization from the external tool 2. Processing by this routine ends for cases where there is no request for initialization. When there is a request for initialization, processing advances to a next step 203. That is, the external tool 2 is connected to the electronic control unit 1 during failure diagnosis, and if there is an initialization request signal inputted from the external tool 2 after a failure location has been repaired, or the like, processing proceeds to the next step 203.

For cases where failure to the throttle valve 7 or the throttle position sensor 8 is detected, the detected failure location is repaired. When the failure is detected, it is stored in the memory 1*a* as failure information relating to electronic control of the throttle valve, and therefore it is necessary to reset the failure information after the failure location is repaired. The memory that stores the failure information is then initialized by using the external tool 2.

Next, in step 203, the electronic control unit 1 judges whether or not the vehicle is stopped. Processing by this routine ends for cases where the vehicle is not stopped.

When the vehicle is stopped, processing proceeds next to a next step 204. That is, when the vehicle speed read in is zero (0), the vehicle is judged to be stopped, and processing proceeds to the next step 204.

Next, in step 204, the electronic control unit 1 judges whether or not the gear shift position of the vehicle is in a neutral range or a parking range. For cases where the gear shift position is not in a neutral range or a parking range, processing by this routine ends. When the gear shift position of the vehicle is in a neutral range or a parking range, processing proceeds to a next step 205. That is, processing proceeds to the next step 205 when the read-in gear shift position of the vehicle is in a neutral range or a parking range.

Then, in step 205, the electronic control unit 1 performs initialization of the memory that stores failure information relating to electronic control of the throttle valve. That is, the memory 1*a* that stores the failure information relating to electronic control of the throttle valve 7 is initialized. For example, an applicable area of the memory 1*a* is changed to initial values present when a battery is connected.

According to Embodiment 2, by initializing the memory 1*a* that stores the failure information, the engine speed increases but the vehicle can maintain a stopped state even for cases where the throttle valve 7 is in a failed state, failsafe control has been released, and the throttle is completely open. Vehicle reliability can therefore be assured.

What is claimed is:

1. An electronic throttle control system comprising:

an electronic control unit that performs failsafe control for cases where throttle valve failure is detected, and stores failure information about the throttle valve in a memory so that the failure information can be referenced by an external tool during failure diagnosis, and that initializes the memory when repair of the failure location is complete, or in order to reconfirm the failure location; and an operation state detection sensor for detecting an operation state of a vehicle;

wherein:

the electronic control unit initializes the memory for cases where an initialization request signal for initializing the memory that stores the throttle valve failure information is inputted from the external tool, and the operation state of the vehicle detected by the operation state detection sensor is a stopped state.

2. The electronic throttle control system according to claim 1, wherein:

the operation state detection sensor is a crank angle sensor for detecting engine speed; and the electronic control unit initializes the memory for cases where the initialization request signal is inputted, and the engine speed that is computed based on the crank angle detected by the crank angle sensor is zero.

3. The electronic throttle control system according to claim 1, wherein:

the operation state detection sensor is a vehicle speed sensor that detects a speed of a vehicle, and a gear shift position switch that detects a gear shift position of the vehicle; and the electronic control unit initializes the memory for cases where the initialization request signal is inputted, the vehicle speed detected by the vehicle speed sensor is zero, and the gear shift position detected by the gear shift position switch is in a neutral range or a parking range.

* * * * *